US005606769A

United States Patent [19]

Tomasiak et al.

[11] Patent Number: 5,606,769

[45] Date of Patent: Mar. 4, 1997

[54] WET/DRY UTILITY VACUUM CLEANER WITH DETACHABLE BLOWER

[75] Inventors: Mark J. Tomasiak, O'Fallon; Jeffrey L. Young, St. Peters; Stuart V. Holsten, O'Fallon, all of Mo.

[73] Assignee: Emerson Electric Co., St. Louis, Mo.

[21] Appl. No.: 332,591

[22] Filed: Oct. 31, 1994

[51] Int. Cl.[6] ..... A47L 5/36; A47L 7/04

[52] U.S. Cl. ..... 15/327.6; 15/327.2; 15/330; 417/236; 417/360; 417/423.15

[58] Field of Search ..... 15/327.1, 327.2, 15/327.6, 328, 330; 417/236, 423.2, 423.15, 360

[56] References Cited

U.S. PATENT DOCUMENTS

| | | | |
|---|---|---|---|
| 4,270,668 | 6/1981 | Berfield | 220/324 |
| 4,501,378 | 2/1985 | Berfield | 220/324 |
| 4,512,713 | 4/1985 | Berfield | 415/119 |
| 4,538,971 | 9/1985 | Miller et al. | 417/423 |
| 4,797,072 | 1/1989 | Berfield et al. | 417/423.2 |
| 4,836,753 | 6/1989 | Berfield et al. | 417/236 |
| 4,845,793 | 7/1989 | Meyer | 15/328 |
| 4,880,364 | 11/1989 | Berfield et al. | 417/423 |
| 5,005,251 | 4/1991 | Mc Leod et al. | 15/328 X |
| 5,404,614 | 4/1995 | Stephens | 15/327.2 |

*Primary Examiner*—Chris K. Moore

*Attorney, Agent, or Firm*—Polster, Lieder, Woodruff & Lucchesi

[57] ABSTRACT

A wet/dry utility vacuum cleaner with detachable blower is disclosed. The detachable blower, when mounted in sealed relationship to a lid positioned above a utility vacuum cleaner drum, operates as a wet/dry utility vacuum cleaner. When separated from the utility vacuum cleaner drum, the detachable blower can be used for non-vacuuming applications. The utility vacuum drum lid includes two detachable latches, a detachable blower latch and a detachable drum latch. The detachable blower latch detachably mounts the detachable blower to the lid while the detachable drum latch detachably mounts the lid relative to the utility vacuum cleaner drum. The detachable blower includes a U-shaped handle positioned in proximity to the detachable blower latch to enable gripping the U-shaped handle while permitting operation of the detachable blower latch for engaging or disengaging the detachable blower relative to the lid. Additional features incorporated in the detachable blower include a stable platform to enable the detachable blower to stand in an upright condition and a scroll design exhaust to increase blower efficiency. The wet/dry vacuum cleaner includes a diffuser for exhaust air flow providing circumferential air exhaust for reducing the velocity of exhaust air.

12 Claims, 13 Drawing Sheets

WET/DRY UTILITY VACUUM CLEANER WITH DETACHABLE BLOWER

CROSS REFERENCE TO RELATED APPLICATIONS

This is a related copending application to Ser. No. 08/303,689, filed Sep. 9, 1994 entitled UTILITY VACUUM CLEANER TOOL CADDY AND WHEEL MOUNT, now U.S. Pat. No. 5,528,794, and Ser. No. 08/236,198, filed May 2, 1994 entitled METHOD OF ASSEMBLING AN ELECTRIC MOTOR now U.S. Pat. No. 5,487,213, both of which are assigned to the same assignee as the present invention.

BACKGROUND OF THE INVENTION

The present invention relates to a wet/dry utility vacuum cleaner with detachable blower, and more particularly to the features incorporated in the detachable blower for separate operation as well as joint operation with the wet/dry utility vacuum cleaner. Wet/dry utility vacuum cleaners with detachable blowers are well known in the art. One typical example is shown in U.S. Pat. No. 4,797,072 in which the detachable blower, when mounted to a utility vacuum cleaner drum, serves to provide a jointly operating wet/dry utility vacuum cleaner drum unit; however, when the detachable blower is separated from the vacuum cleaner drum, the detachable blower can be used for a variety of different blower applications. The wet/dry utility vacuum cleaner with detachable blower of the present invention functions generally in the manner described above; however, it provides numerous improved features to facilitate the joint or separate use of the detachable blower relative to the wet/dry utility vacuum cleaner, as will be described in detail below.

SUMMARY OF THE INVENTION

Among the several objects and advantages of the present invention include:

The provision of a new and improved wet/dry utility vacuum cleaner with detachable blower;

The provision of the aforementioned wet/dry utility vacuum cleaner with detachable blower in which the detachable blower has a one handed release and pivot relative to a utility vacuum cleaner lid in order to remove/install the detachable blower relative to the utility vacuum cleaner lid;

The provision of the aforementioned wet/dry utility vacuum cleaner with detachable blower in which the detachable blower incorporates a large, easy to use and well balanced handle for ease of gripping and use of the detachable blower;

The provision of the aforementioned wet/dry utility vacuum cleaner with detachable blower that includes supporting pads in order to allow the detachable blower to be rested in an upright position while operating without danger of vacuuming in debris through vent slots in the detachable blower;

The provision of the aforementioned wet/dry utility vacuum cleaner with detachable blower that provides both a releasable blower latch and a releasable lid latch for single one-handed positive engagement/release to enhance the ease and speed of removing the detachable blower relative to the lid and the lid relative to a vacuum cleaner drum; and The provision of the aforementioned wet/dry utility vacuum cleaner with detachable blower that is well constructed, easy to operate, easy to maintain and clean, strong and durable for long lasting operation and is otherwise well adapted for the purposes intended.

Briefly stated, the wet/dry utility vacuum cleaner with detachable blower includes a vacuum cleaner drum having a bottom wall, a side wall and an enlarged rim surrounding an open upper end of the drum. A lid is detachably mounted to the enlarged rim and extends across the open upper end of the vacuum cleaner drum. Within the lid is a depression or recessed cavity that includes an opening in its lower wall which communicates with the drum. A filter element is mounted over the wall cavity within the drum and surrounds the opening in the depression or recessed cavity. Mounted within the depression or recessed cavity is a motor powered blower that may be detached from to the lid for independent operation separate from the lid and drum. The detachable blower includes intake vent slots overlying the opening in the lower wall of the depression or recessed cavity and an exhaust port spaced from the intake vent slots. The lid has a circumferential sealing shoulder surrounding the depression or recessed cavity which engages a complementary shaped circumferential shoulder provided on the detachable blower in order to seal the detachable blower relative to the lid when the detachable blower is mounted to the lid. Thus, the detachable blower, when mounted to the lid, acts to exhaust air from the drum.

The lid includes a releasable blower latch for engaging the detachable blower and holding the circumferential sealing shoulders of the lid and blower in sealing engagement with one another. The releasable blower latch is pivotally mounted to the lid and releasable engages a complementary latch opening in the blower spaced from the circumferential sealing shoulders in the lid and the blower. The releasable blower latch includes an upstanding finger engaging portion for moving the releasable blower latch into engagement or disengagement relative to the blower.

The detachable blower includes a U-shaped handle extending outwardly from the detachable blower immediately above the releasable blower latch. The U-shaped handle and releasable blower latch are mounted in proximity to one another to enable a user to both grip the U-shaped handle and with one finger engage or disengage the releasable blower latch for removal or replacement of the detachable blower relative to the depression or recessed cavity in the lid.

The detachable blower includes supporting pads at an end opposite from the U-shaped handle for resting the blower on a supporting surface in an upright position. When resting in the upright position, the intake vent slots are positioned on the side of the blower to enable continuous blower operation without vacuuming debris into the intake vent slots. The U-shaped handle extends to one side of the blower housing on a side opposite the blower exhaust to facilitate lifting and carrying the blower while operating same. The U-shaped handle includes switch means for operating the detachable blower.

The lid also includes a releasable lid or drum latch for engaging the large rim of the drum. The releasable lid or drum latch is pivotally mounted to the lid and includes a releasable locking element for engaging the enlarged rim and a finger gripping section for engaging or disengaging the releasable lid or drum latch to the enlarged rim of the drum. The releasable locking element is resilient and deflectable for camming locking engagement with the enlarged rim. The upper end of the releasable drum latch includes aligned and spaced pivot posts extending laterally outwardly from the releasable drum latch for pivotal mounting to spaced supports extending radially outwardly from the lid. The upper end of the releasable drum latch is resilient and deformable between the aligned and spaced pivot posts to enable the aligned and spaced pivot posts to be moved inwardly prior to being received within complementary shaped mounting holes of the spaced supports in the lid. The upper end of the releasable drum latch includes a series of aligned and spaced sections for facilitating the resilient and deformable operation of the pivot posts relative to the complementary shaped mounting holes of the spaced supports.

These and other objects and advantages of the present invention will become more apparent from the description that follows.

BRIEF DESCRIPTION OF THE DRAWINGS

In the drawings.

Corresponding reference numerals will be used throughout the several figures of the drawings.

DESCRIPTION OF THE PREFERRED EMBODIMENTS

The following detailed description illustrates the invention by way of example and not by way of limitation. The description will clearly enable one skilled in the art to make and use the invention, describes several embodiments, adaptions, variations, alternatives and uses of the invention, including what we presently believe is the best mode of carrying out the invention.

Figure 2:
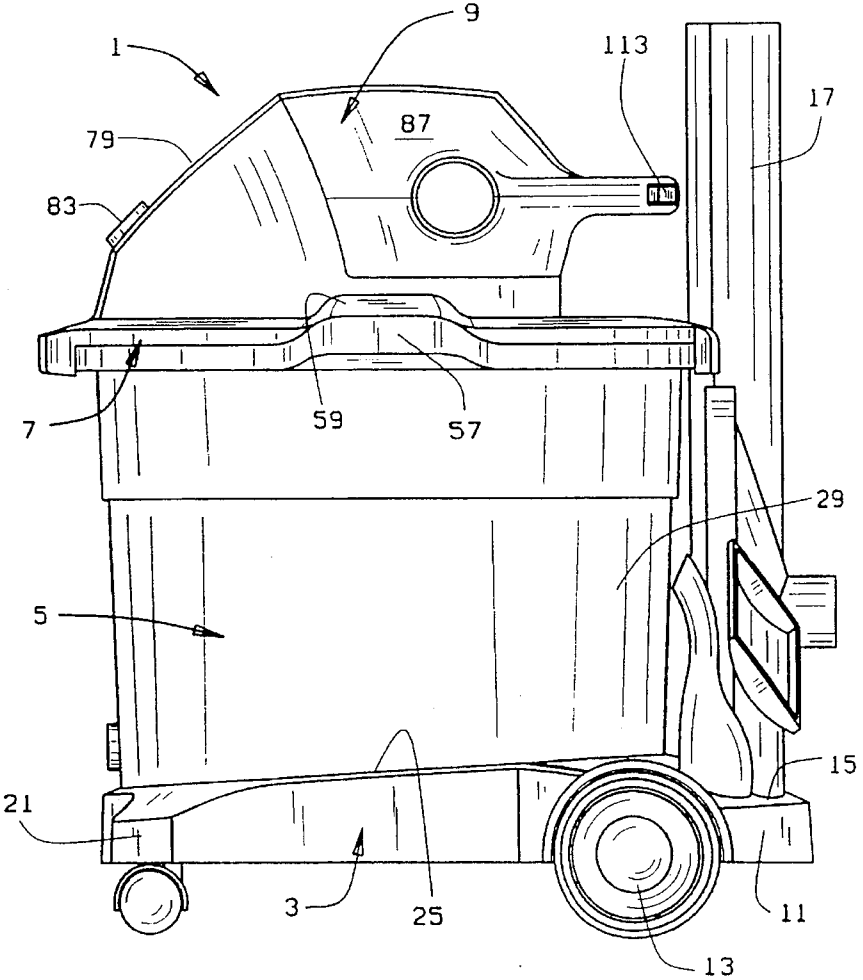
FIG. 2 is a side elevational view of the wet/dry utility vacuum cleaner with detachable blower illustrated in FIG. 1.
Figure 1:
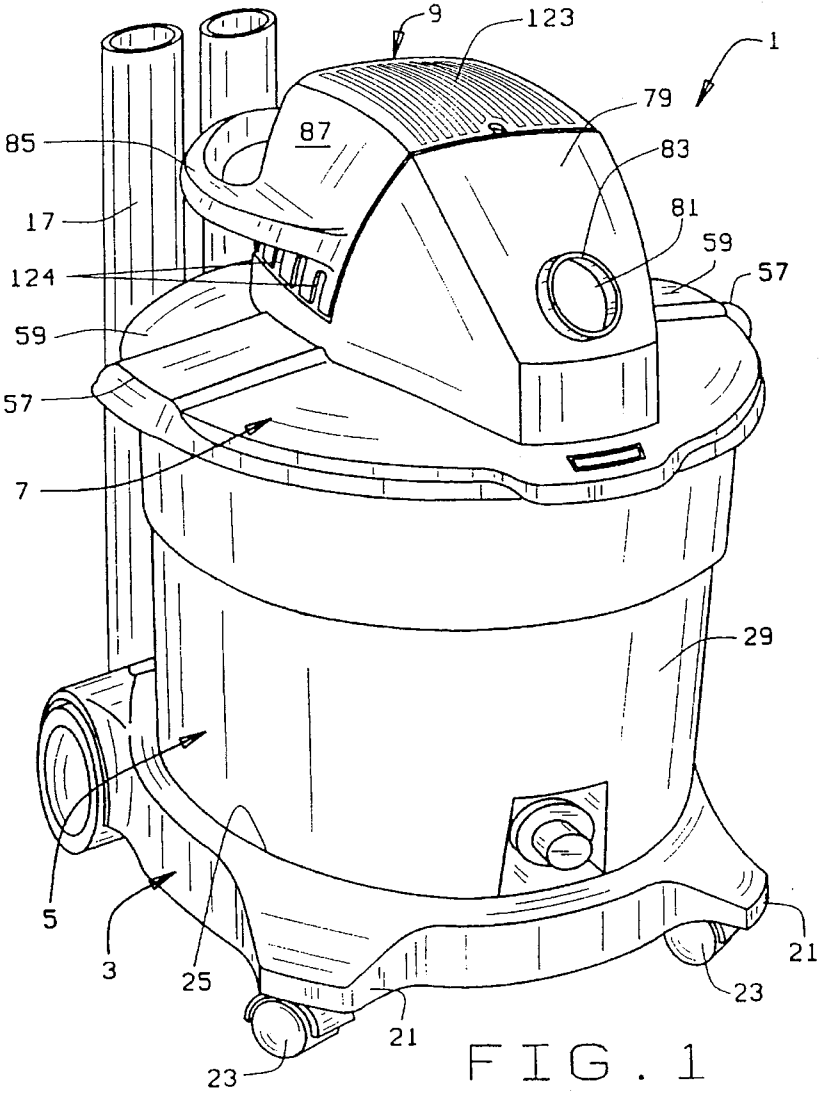
FIG. 1 is a front perspective view of the wet/dry utility vacuum cleaner with detachable blower constructed in accordance with the teachings of the present invention.

The wet/dry utility vacuum cleaner with detachable blower 1 shown in FIGS. 1–2 of the drawings includes a tool caddy 3 which receives a vacuum cleaner drum 5, a lid 7 that covers the open upper end of the vacuum cleaner drum 5 and a detachable blower 9 that is received within complementary shaped cavities or openings of the lid 7. The detachable blower 9 is also capable of being separated from the lid 7 for independent use, as desired.

The tool caddy 3 is constructed as a one-piece molded unit from polypropylene or other similar suitable material. The tool caddy 3 includes a rear bumper 11 for the spaced large terrain wheels 13, 13. In addition, the rear bumper 11 includes a series of spaced tool openings 15 (see FIG. 3) for receiving a series of vacuum tools 17 as illustrated in FIGS. 1–2 of the drawings. The tool caddy 3 further includes spaced front bumper sections 21, 21 which are adapted to overlie and protect individual wheel casters 23, 23, as best seen in FIGS. 1–2 of the drawings. The tool caddy 3 incorporates a central depression 25 for receiving the vacuum cleaner drum 5, as illustrated in FIGS. 1–6 of the drawings.

For a further detailed description of the construction and operation of the tool caddy 3 in conjunction with the wet/dry utility vacuum cleaner with detachable blower of the present invention, reference is made to copending patent application Ser. No. 08/303,689, filed Sep. 9, 1994, entitled UTILITY VACUUM CLEANER TOOL CADDY AND WHEEL MOUNT now U.S. Pat. No. 5,528,794 which is assigned to the same assignee as the present invention.

Figure 4:
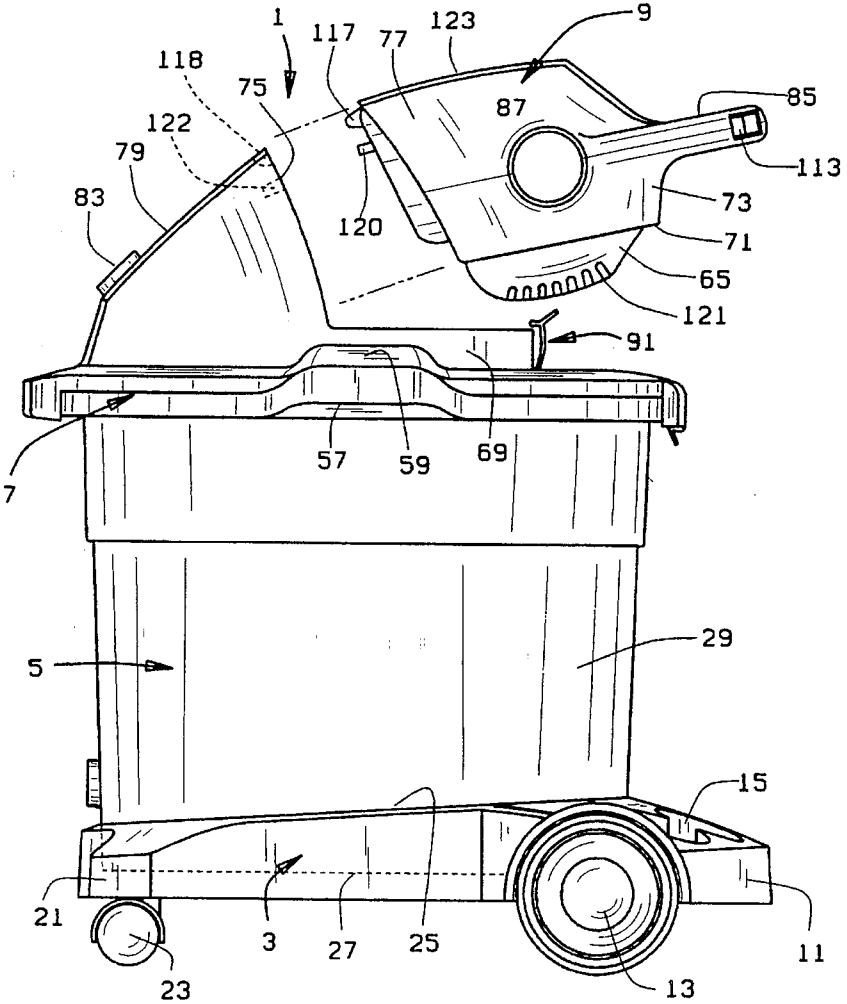
FIG. 4 is an exploded side elevational view of the wet/dry utility vacuum cleaner with the detachable blower removed therefrom.

The vacuum cleaner drum 5 includes a bottom wall 27 shown in dotted lines in FIG. 4 of the drawings which rests on supporting sections within the central depression 25 of the tool caddy. Extending upwardly from the bottom wall is a side wall 29 which terminates in an enlarged rim 31 surrounding an open upper end 33 of the vacuum cleaner drum 5, as shown in FIG. 13 of the drawings. The lid 7 is detachably mounted to an enlarged rim 31 of the vacuum cleaner drum 5 and extends across the open upper end 33 of the vacuum cleaner drum 5. In order to secure the detachable lid 7 to the enlarged rim 31 at the upper end of the vacuum cleaner drum 5, the detachable lid 7 includes a hook portion or pivot element 35 (see FIG. 12) which is adapted to engage beneath the enlarged rim 31 when the lid 7 is positioned at an angle relative to the enlarged rim 31 to enable a limited range of pivotal movement of the lid 7 relative to the vacuum cleaner drum 5 from the aforementioned angular position to a generally transverse position of the lid when mounted in closed position over the open upper end 33 of the vacuum cleaner drum 5.

The detachable lid 7 includes a releasable lid or drum latch 37 which is provided in the lid 7 at a location generally opposite the hook shaped pivot element 35. The releasable lid or drum latch 37 is formed independently of the lid 7 and is pivotally mounted to the lid 7 at 39, as best seen in FIG. 13 of the drawings. The lower end of the releasable lid or drum latch 37 includes a finger gripping section 41 to enable a user to grip the finger gripping section 41 for moving the releasable drum latch 37 into and out of engagement relative to the enlarged rim 31 of the vacuum cleaner drum 5. Intermediate the pivotal section 39 at the upper end and the finger gripping section 41 at the lower end of the releasable drum latch 37 is a releasable locking element 43 that is configured, arranged and dimensioned for releasable locking engagement beneath the enlarged rim 31 of the vacuum cleaner drum 5. As best seen in FIG. 13 of the drawings, the releasable locking element 43 includes a combined L-shaped section 45 and a up-side-down U-shaped section 47 which are integrally interconnected to one another and enable the up-side-down U-shaped section 47 to extend sufficiently radially inwardly to form the releasable lid or locking element 43 that underlies the enlarged rim 31 when the releasable drum latch 37 is pivotally moved about the pivot section 39 to an engaged position beneath the enlarged rim 31, as shown in FIG. 13 of the drawings. It will be appreciated that since the releasable lid or drum latch 37 is integrally molded from a flexible plastic material, the releasable locking element 43 is resilient and deflectable for camming locking engagement beneath the enlarged rim 31, as shown in FIG. 13.

Figure 3:
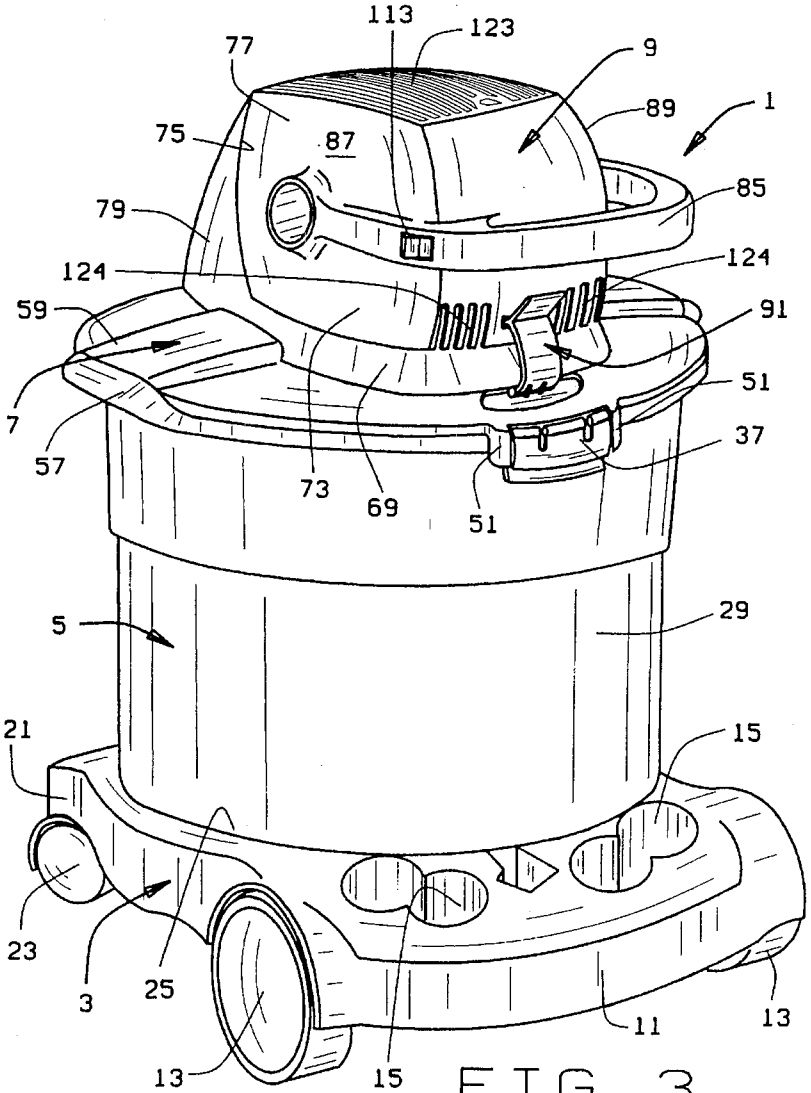
FIG. 3 is a rear perspective view of the wet/dry utility vacuum cleaner with detachable blower of the present invention.
Figure 11:
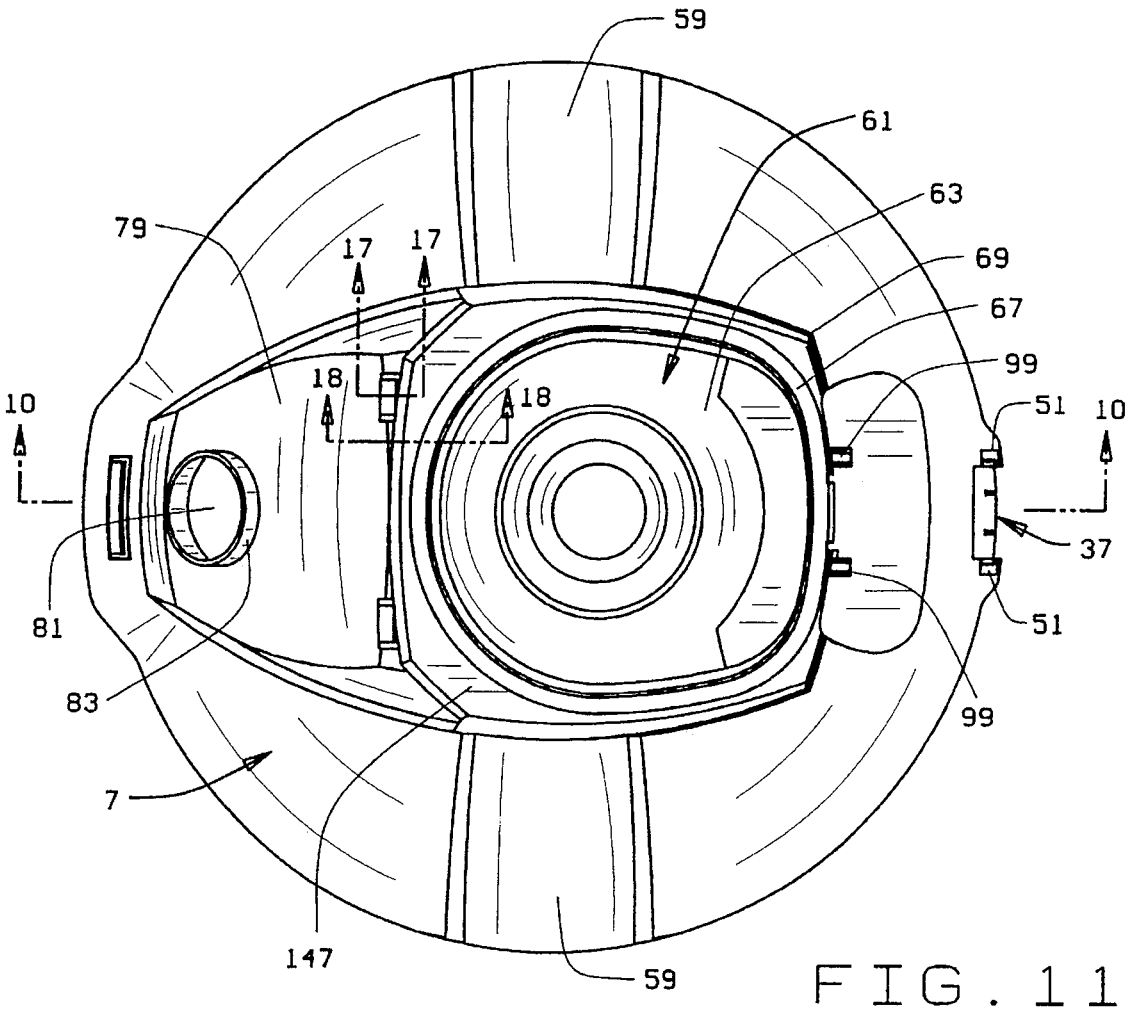
FIG. 11 is a top plan view of the lid including a lid depression or recessed cavity which receives the detachable blower when the detachable blower is mounted to the wet/dry utility vacuum cleaner.

The upper pivot 39 includes spaced and aligned posts 49, 49 that extend laterally outwardly from the releasable lid or drum latch 37 for pivotal mounting at 39 to spaced supports 51, 51 of the lid 7, as shown in FIG. 3 and 11, for the pivotal mounting of the releasable drum latch 37. Between the spaced and aligned pivot posts 49, 49, the releasable lid or drum latch 37 at its upper end includes a series of aligned and spaced sections 53, 53, 53 separated by openings 55, 55, in order to allow the pivot posts 49, 49 to be resiliently deformed inwardly relative to complementary shaped mounting holes (not shown) provided in the spaced supports 51, 51. Once the spaced and aligned posts 49, 49 are received within complementary shaped mounted holes of the supports 51, 51, the aligned and spaced sections 53, 53, 53 return to their normal condition for securing drum latch 37 in assembled position relative to the spaced supports 51, 51 of the lid 7.

The vacuum cleaner drum 5 also includes spaced and opposed drum lifting handle sections 57, 57 each of which are 90° offset from the hook shaped pivot element 35 and releasable drum latch 37. These drum lifting handle sections 57, 57 are aligned relative to integral strut elements 59, 59 formed in the lid 7 for strengthening the drum lifting handle sections 57, 57 for lifting the vacuum cleaner drum 5.

Figure 12:
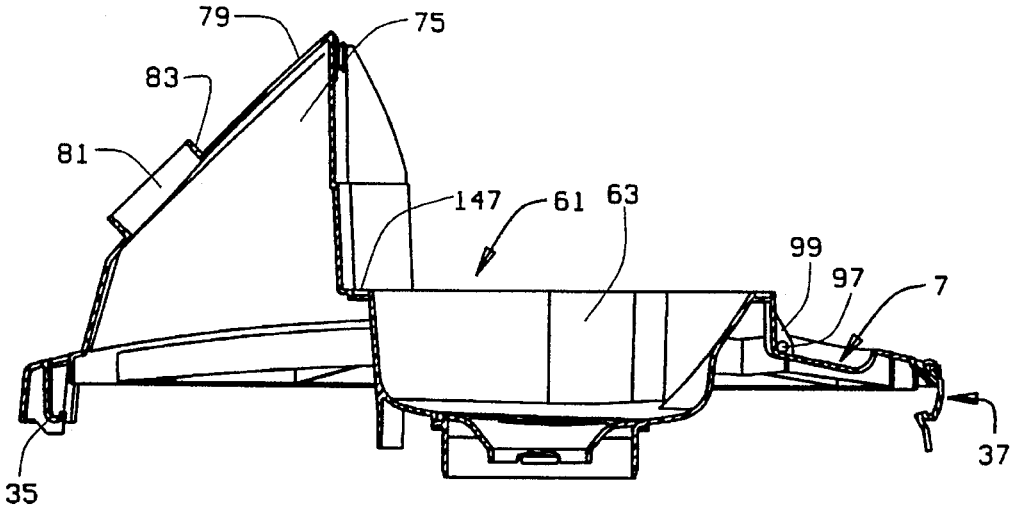
FIG. 12 is a sectional view of the lid including lid depression or recessed cavity illustrated in FIG. 11 of the drawings and also including releasable drum latch mounted to the lid and the hook shape pivot.
Figure 13:
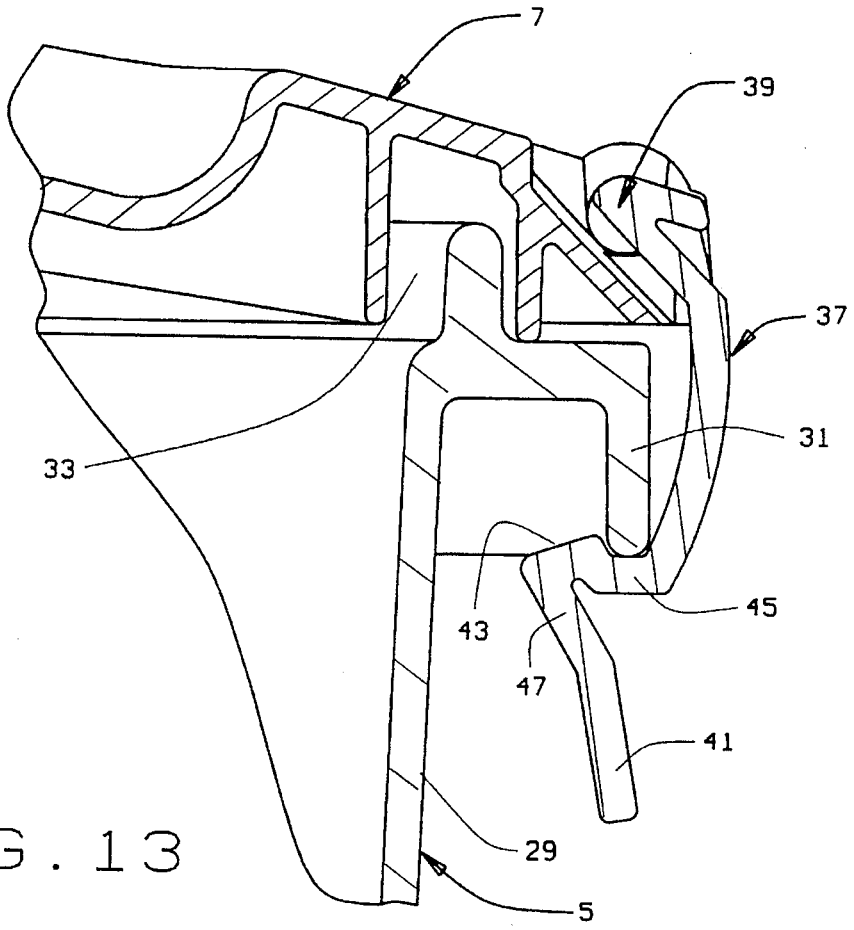
FIG. 13 is an enlarged sectional view of the releasable drum latch mounted to the lid for engagement with an enlarged rim at the open upper end of the vacuum cleaner drum.
Figure 14:
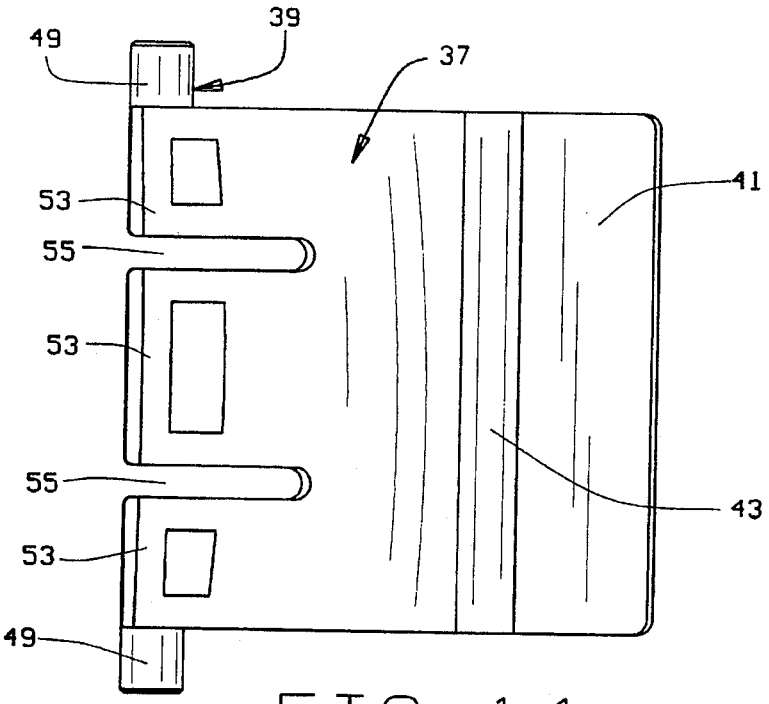
FIG. 14 is a top plan view of the releasable drum latch.

For receiving the detachable blower 9, the lid 7 includes a depression or recessed cavity 61, as best seen in FIGS. 11–12 of the drawings. The depression or recessed cavity 61 includes a lower wall cavity 63 that is complementary to a lower portion of the detachable blower 9. Specifically, depression or recessed cavity 63 has a complementary shape and configuration to the lower portion 65 of the detachable blower 9, as shown in FIG. 4, in order that the lower portion 65 of the detachable blower 9 can be readily received within the depression or recessed cavity 63. The depression or recessed cavity 63 includes an inner supporting wall 67 and an outer wall 69 spaced from the inner wall 67. The depression or recessed cavity 63 is contained within an elevated portion of the lid 7 defined by a surrounding outer wall 69 and a surrounding upper wall containing a groove 147 for a gasket 149. The surrounding upper wall of the depression or recessed cavity 63 and the gasket 149 serve to support the detachable blower 9 in stable condition within the depression or recessed cavity 63 and in sealed relationship with the lid 7, as illustrated by the assembled and disassembled positions of the detachable blower relative to the wet/dry utility vacuum cleaner 1 shown in FIGS. 3–4 of the drawings. In addition, the lower wall of the depression or recessed cavity 63 contains an opening 133 through the lid 7 which communicates with the interior of the drum 5.

In addition to the depression or reversed cavity 63, the lid 7 includes an upper raised cavity 75 for partially receiving the end portion 77 of the detachable blower, as also illustrated in the assembled and disassembled positions of the detachable blower illustrated in FIGS. 3–4 of the drawings. The upper raised cavity 75 is formed by an extension of the outer wall 69 of the depression or recessed cavity 63 that also extends upwardly to form an enclosed hood 79 that overlies part of the end portion 77 of the detachable blower 9 when the detachable blower 9 is received within the upper raised cavity 75, as explained above. The hood 79 is complementary configured relative to the end portion 77 of the detachable blower 9 and is also ornamentally shaped and configured to form the construction illustrated in FIGS. 1–8 and 11–12 of the drawings. The hood 79 includes a vacuum inlet 81 that communicates with the upper raised cavity 75 that opens up into the interior of the vacuum cleaner drum 5. The vacuum inlet 81 receives a vacuum hose in a friction fit assembled relationship along the inner wall of the collar 83 which defines the vacuum inlet 81. The manner in which the vacuum inlet 81 communicates with the interior drum 55 and the other operating components of the wet/dry utility vacuum cleaner with detachable blower 1 will be further explained in detail below.

As best seen in FIG. 3–4 of the drawings, the detachable blower 9 is used jointly with the wet/dry utility vacuum cleaner 1 as shown in FIG. 3 or is used independently as a blower for non-vacuuming applications, as illustrated in FIG. 4 of the drawings. For this purpose, a U-shaped handle is integrally molded to opposite spaced sides 87, 89 of the injection molded blower housing, as best seen in FIGS. 1–4 and 7–8 of the drawings. Thus, a user can readily lift the detachable blower 9 using the U-shaped handle 85 from the depression or recessed cavity 61, including the lower wall cavity 63 and the upper raised cavity 75 of the lid 7. However, before this can be accomplished, the releasable blower latch 91, pivotally mounted to the lid 7, must be moved to a disengaged position relative to the blower 9. In order to understand the operation of the releasable blower latch 91 relative to the blower 9, reference is made to FIGS. 7–12 of the drawings.

The releasable blower latch 91 is pivotally mounted at 93 (see FIGS. 9–10) to the lid 7 through the use of spaced and aligned posts 95, 95 that extend outwardly from the releasable drum latch 91 for reception within complementary shaped holes 97 (see FIG. 12) of the spaced integral support plates 99, 99 formed in the lid 7 (see FIGS. 11–12). Like the releasable drum latch 37, the upper end of the releasable blower latch 91, in alignment with the spaced posts 95, 95 include a series of aligned and spaced sections 101, 101, 101 separated by openings 103, 103, in order to allow the pivot posts 95, 95 to be resiliently deformed inwardly relative to the complementary shaped mounting holes 97, 97 provided in the spaced support plates 99, 99. Once the spaced and aligned post 95, 95 are received within the complementary shaped mounting holes 97, 97 of the spaced support plates 99, 99, the aligned and spaced sections 101, 101, 101 return to their normal condition for securing detachable blower latch 91 in assembled position relative to the spaced support plates 99, 99 of the lid 7.

Figure 9:
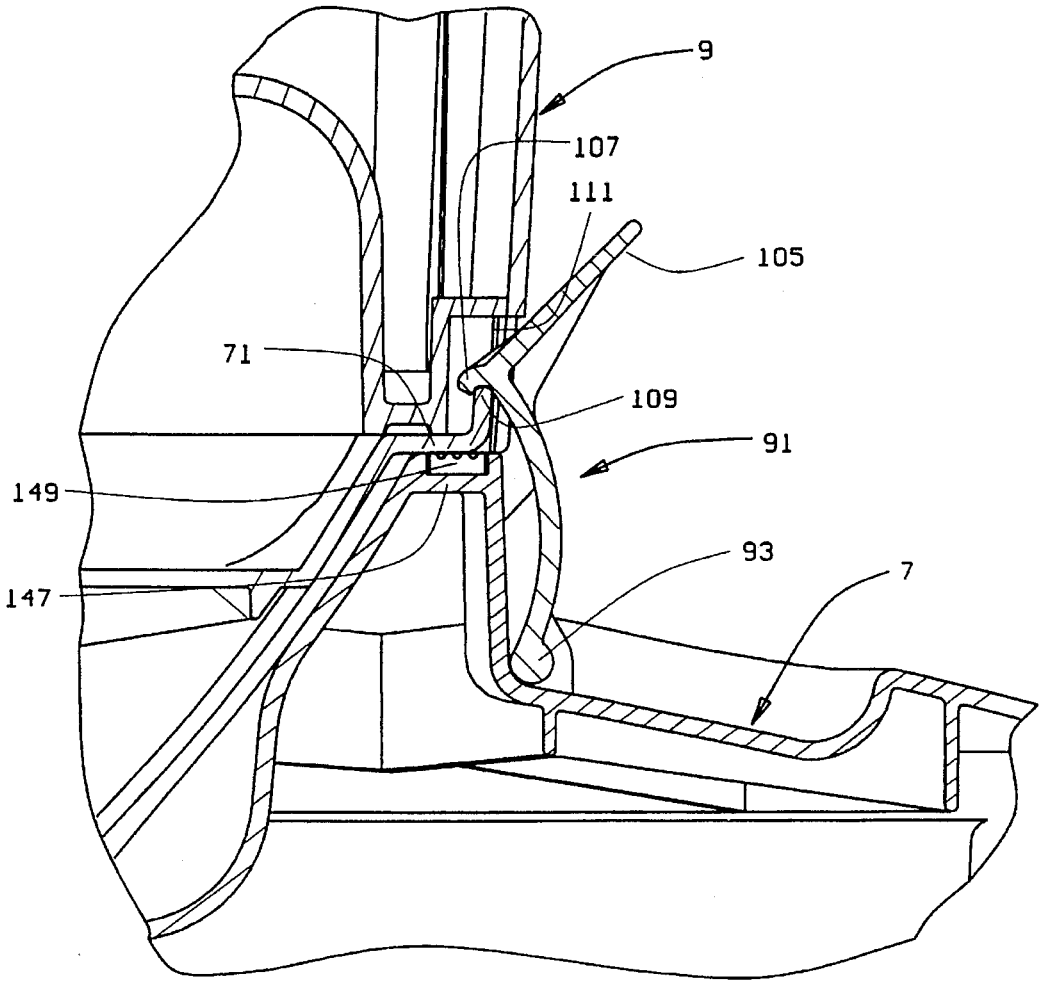
FIG. 9 is a fragmentary enlarged sectional view illustrating the manner in which the releasable blower latch is pivotally mounted to the lid that extends across the vacuum cleaner drum for detachable engagement relative to the detachable blower.
Figure 10:
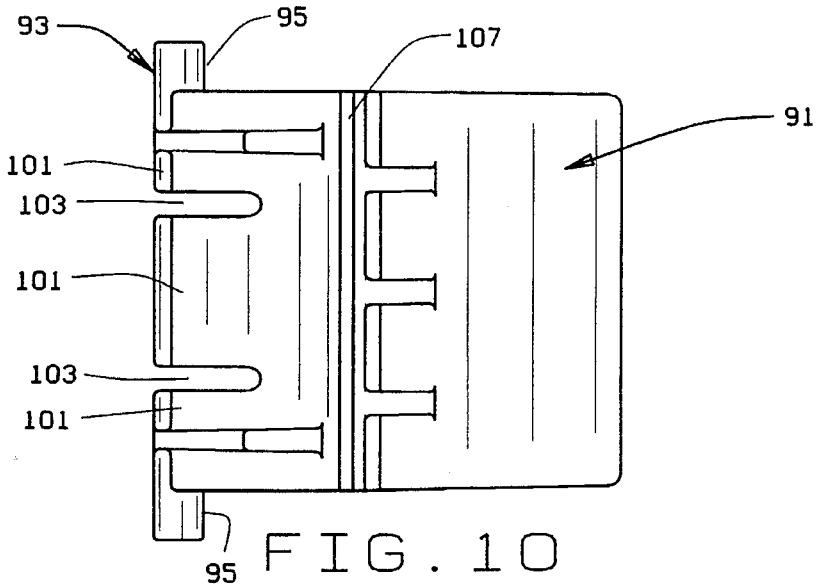
FIG. 10 is a top plan view of the releasable blower latch illustrated in FIGS. 7–9 of the drawings.

At an opposite end from the spaced pivot posts 95, 95, the detachable blower latch 91 includes an upstanding finger engaging portion 105 for moving the detachable blower latch 91 into engagement or disengagement relative to the blower 9. For this purpose, the detachable blower latch 91 includes a flexible locking shoulder 107 that resiliently engages a lower locking shoulder 109 in a complementary latch opening 111 formed in the blower housing, as best illustrated in FIG. 9 of the drawings.

Figure 7:
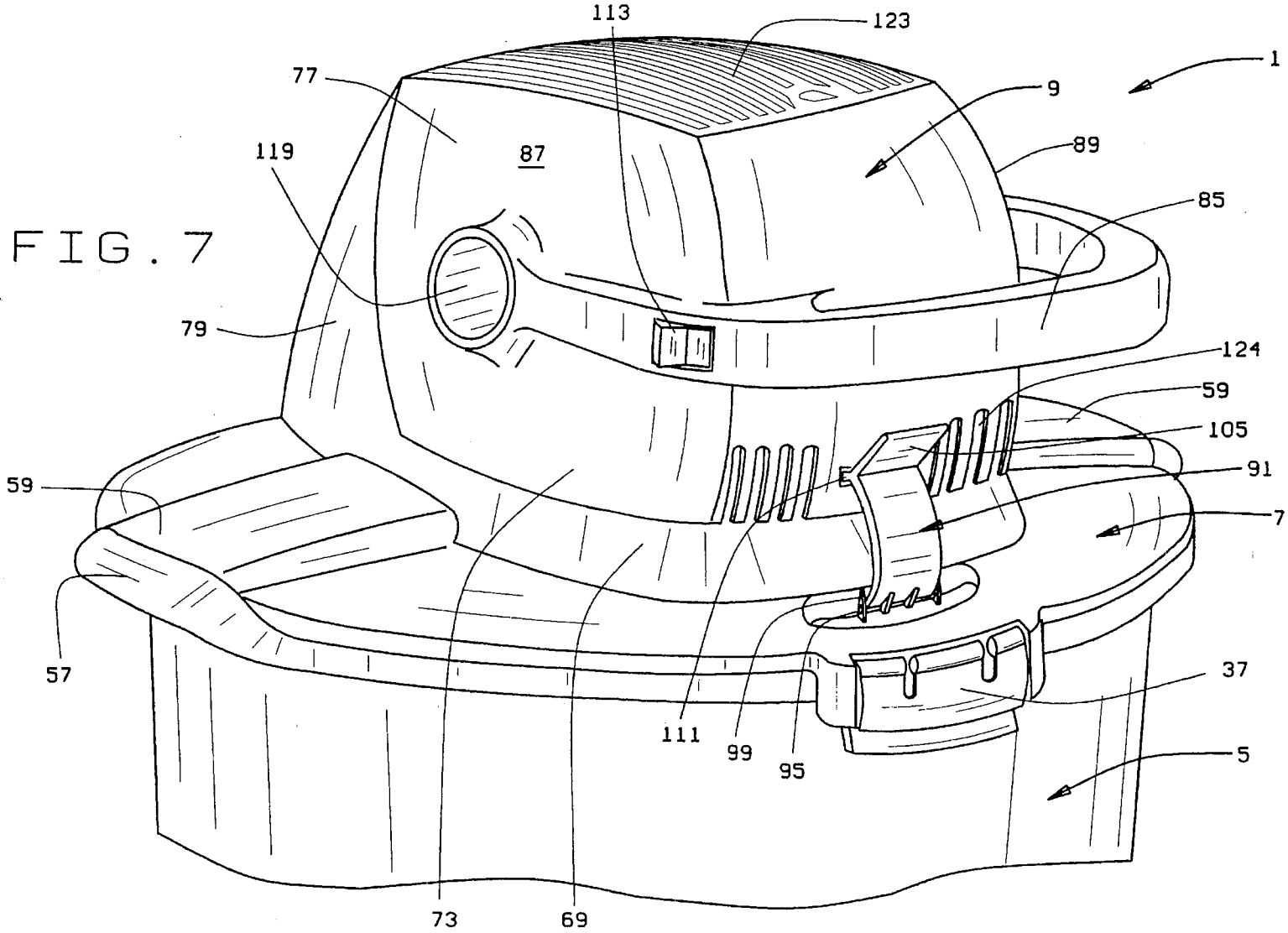
FIG. 7 is a fragmentary enlarged left rear perspective view of the detachable blower mounted and held in position by a releasable blower latch relative to a lid extending across the open upper end of a vacuum cleaner drum used with a wet/dry utility vacuum cleaner.
Figure 8:
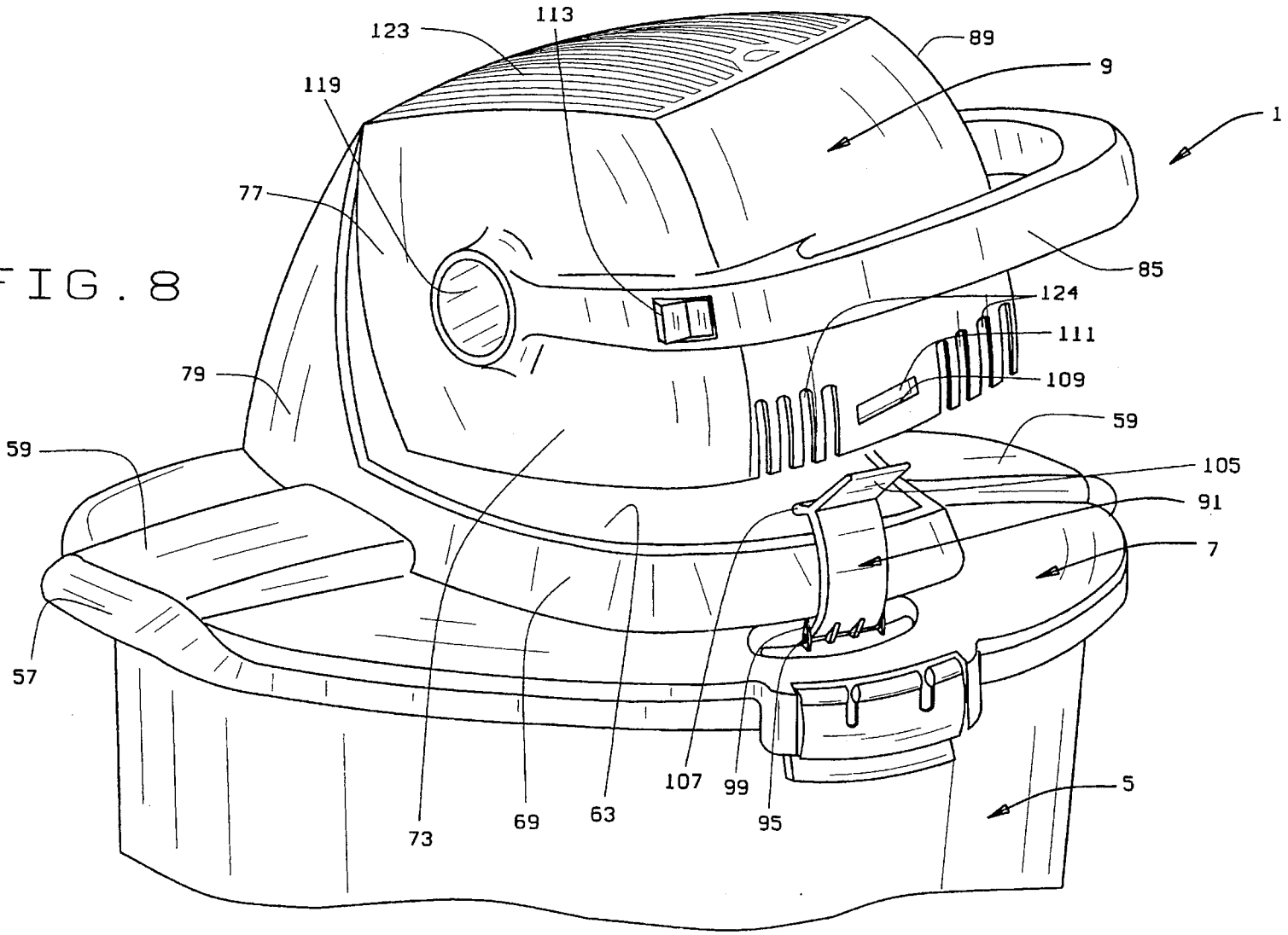
FIG. 8 is a fragmentary enlarged left rear perspective view of the detachable blower as it is removed from the lid that extends across the top of the vacuum cleaner drum, after the detachable blower latch has been disengaged from the releasable blower.

When the detachable blower is operated jointly with respect to the wet/dry utility vacuum cleaner 1, it assumes the position illustrated in FIG. 7 of the drawings where the lower portion 73 of the blower 9 is received within the depression or recessed cavity 61, while the detachable blower latch 91 engages, through its locking shoulder 107, the lower locking shoulder 109 associated with the complementary latch opening 111. When it is desired to disassemble the detachable blower 9 from the wet/dry utility vacuum cleaner 1 as illustrated in FIG. 8 of the drawings, the upstanding finger engaging portion 105 of the detachable blower latch 91 is depressed to move the resilient locking shoulder 107 of the detachable blower latch 91 out of engagement with its complementary engaged lower shoulder 109 of the complementary latch opening 111. As will be understood in describing the operating components of the wet/dry utility vacuum cleaner 1 with detachable blower 9, the detachable blower 9 must be sealed relative to the lid 7 for the proper operation of the wet/dry utility vacuum cleaner 1. The detachable blower latch 91 assists in the proper sealed condition relative to the lid 7, as will be discussed further below.

The U-shaped handle 85 and the detachable blower latch 91 are mounted in proximity to one another to enable a user to both grip the U-shaped handle 85 and with one finger engage or disengage the upstanding finger engaging portion 105 of the detachable blower latch 91 for the removal or replacement of the detachable blower 9 from the lid 7. There is provided a single one-handed positive engagement/release of the detachable blower latch 91 relative to the detachable blower 9 in order to enhance the ease and speed of removing the detachable blower 9 from to the lid 7. The U-shaped handle 85 of the detachable blower 9 also provides one-handed release and pivot of the detachable blower 9 from the depression or recessed cavity 61 of the lid 7 in order to remove/install the detachable blower 9 from/to the lid 7.

For a further description of the general operating components of the detachable blower 9, reference is made principally to FIG. 4–8 and 15 of the drawings. In these drawing figures, it will be seen that the U-shaped handle 85 includes a rocker switch actuator 113 for operating a switch (within the U-shaped handle 85) that operates the detachable blower 9. A user can thus conveniently operate the switch rocker actuator 113 by a thumb or index finger while still gripping the U-shaped handle 85 and simultaneously directing the blower exhaust 119 in the desired direction. The switch 115 is connected to the electric motor contained within the detachable blower for operating same, also to be described below.

Figure 6:
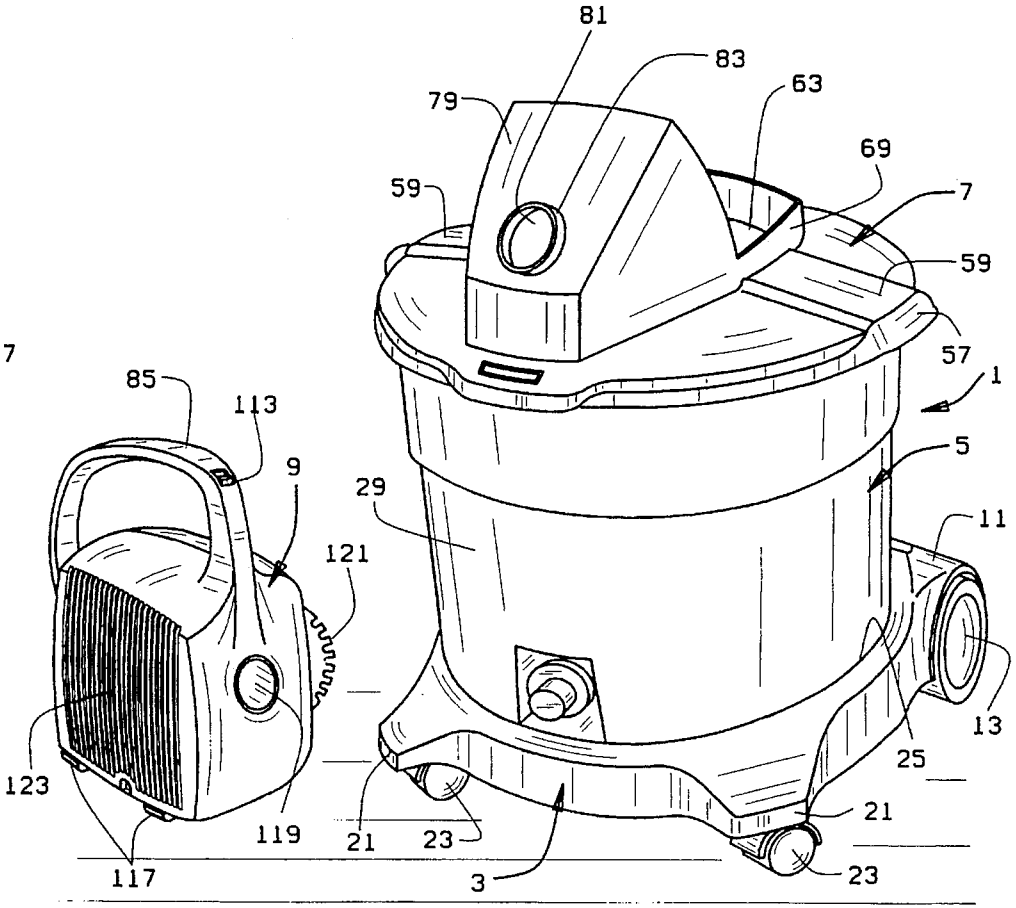
FIG. 6 is a right front perspective view of the wet/dry utility vacuum cleaner with detachable blower resting in an upright condition on a supporting surface.
Figure 5:
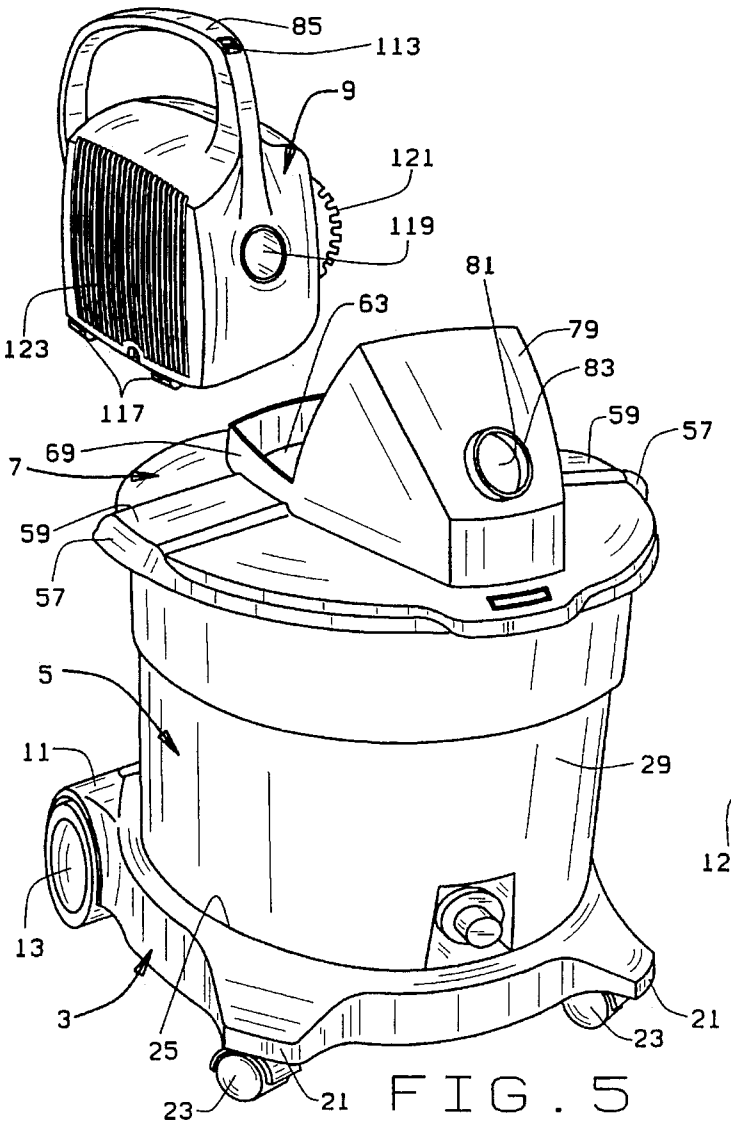
FIG. 5 is an exploded left front perspective view of the wet/dry utility vacuum cleaner with detachable blower removed therefrom for separate operation.

At the opposite end from the U-shaped handle 85, the detachable blower 9 includes supporting pads/pivots 117, 117 for resting the detachable blower on a supporting service in an upright position, as best seen in FIG. 6 of the drawings. The detachable blower 9 has a blower exhaust 119 that is positioned on one side of the blower 9 approximately 90° from the U-shaped handle 85. Air inlet vent slots 121 are formed in the lower end 65 of the detachable blower 9. Motor cooling air exhaust vents 123 are formed on the upper side of the blower 9. The operation of the blower exhaust 119 relative to the air inlet vent slots 121 and the motor exhaust vent slots 123 relative to the motor cooling air inlet vent slots 124 will be explained further below. The supporting pads 117, 117 enable the detachable blower 9 to be supported in an upright position as shown in FIG. 6 in such a way that the inlet vent slots 121 and the motor cooling air inlet slots 124 are spaced away from the supporting surface. As will be appreciated, a user can place the detachable blower 9 on the supporting pads 117, 117 with the detachable blower 9 still operating and with its associated electrical cord plugged into a wall outlet without turning the detachable blower 9 off by operating the switch rocker 113 and without the danger of vacuuming debris through the vent slots 121 or the motor cooling inlet slots 124.

As shown in FIGS. 4 and 16–18, the supporting pads/pivots 117, 117 are pivotally mounted within complementary shaped pivot troughs 118, 118 of the lid 7. A pair of locking tabs 120, 120 are laterally and inwardly offset relative to the supporting pads/pivots 117, 117 for reception within complementary shaped openings 122, 122 in the lid 7. Thus, as long as the detachable blower latch 91 secures the blower 9 in position, it is impossible to lift the blower 9 from the lid 7. However, as soon as the detachable blower latch 91 is released, the blower 9 is easily pivotally mounted on the supporting pads/pivots 117, 117 relative to the pivot troughs 118, 118 while, at the same time, permitting removal of the blower 9 relative to the lid 7.

Figure 15:
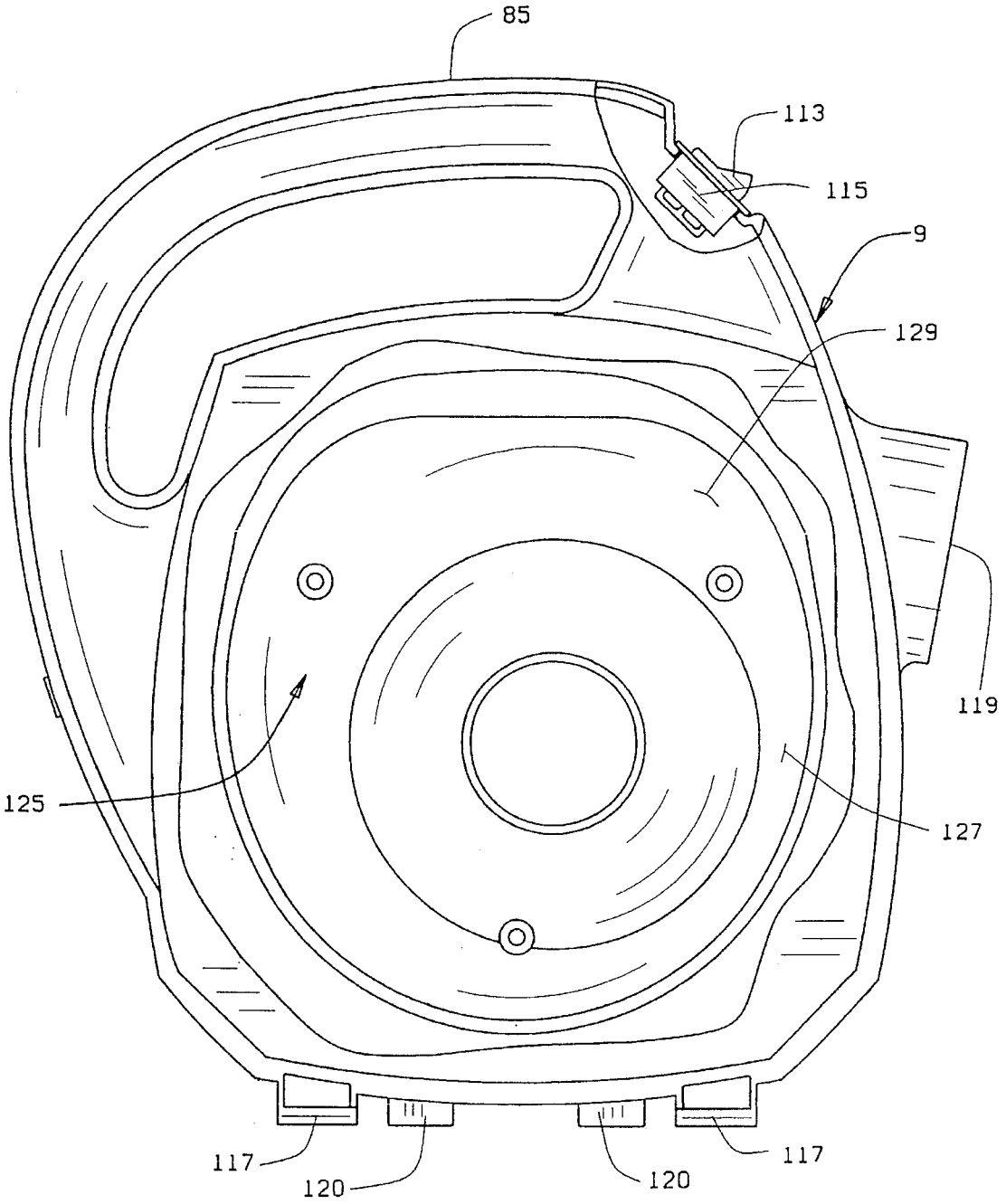
FIG. 15 is an enlarged side elevational view of the detachable blower with one side removed to illustrate the exhaust scroll design for increasing detachable blower efficiency and also showing the relative position of the U-shaped handle relative to the detachable blower.
Figure 16:
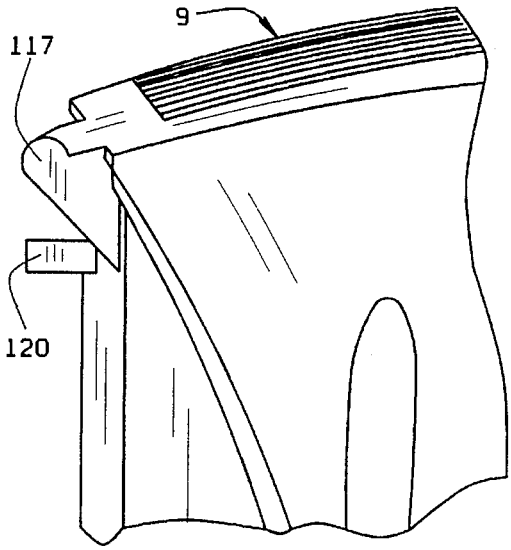
FIG. 16 is a fragmentary side elevational view, partially in section, of the operating components of the detachable blower and the wet/dry utility vacuum cleaner of the present invention.
Figure 17:
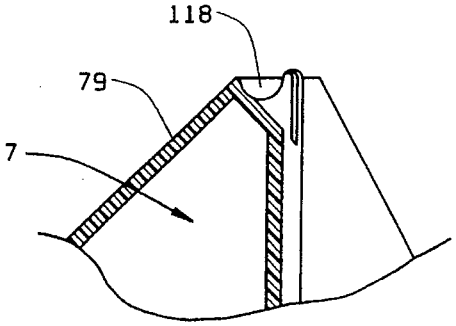
FIG. 17 is an enlarged sectional view of the operating components of the detachable blower and wet/dry utility vacuum cleaner.

In FIG. 15 of the drawings, it will be seen that the U-shaped handle 85 extends or is angled to one side of the blower 9, on a side opposite from the blower exhaust 119, in order to facilitate lifting and carrying the detachable blower 9 while operating same. The U-shaped handle 85 is a large well-balanced handle that provides ease of use while allowing the user to direct the blower exhaust 119 as desired for blowing applications while holding the blower in a stable and easy-to-operate position.

FIG. 15 of the drawings also shows a scroll shaped exhaust passageway 125 that extends from a narrower passageway 127 to a wider passageway 129 adjacent the blower exhaust 119. The narrower blower passageway 127 is connected to an internal blower passageway, presently to be described in connection with the operation of the detachable blower 9, for venting exhaust from the narrower passageway 127 to the wider passageway 129 in order to provide a scroll shaped exhaust passageway that increases blower efficiency.

Figure 20:
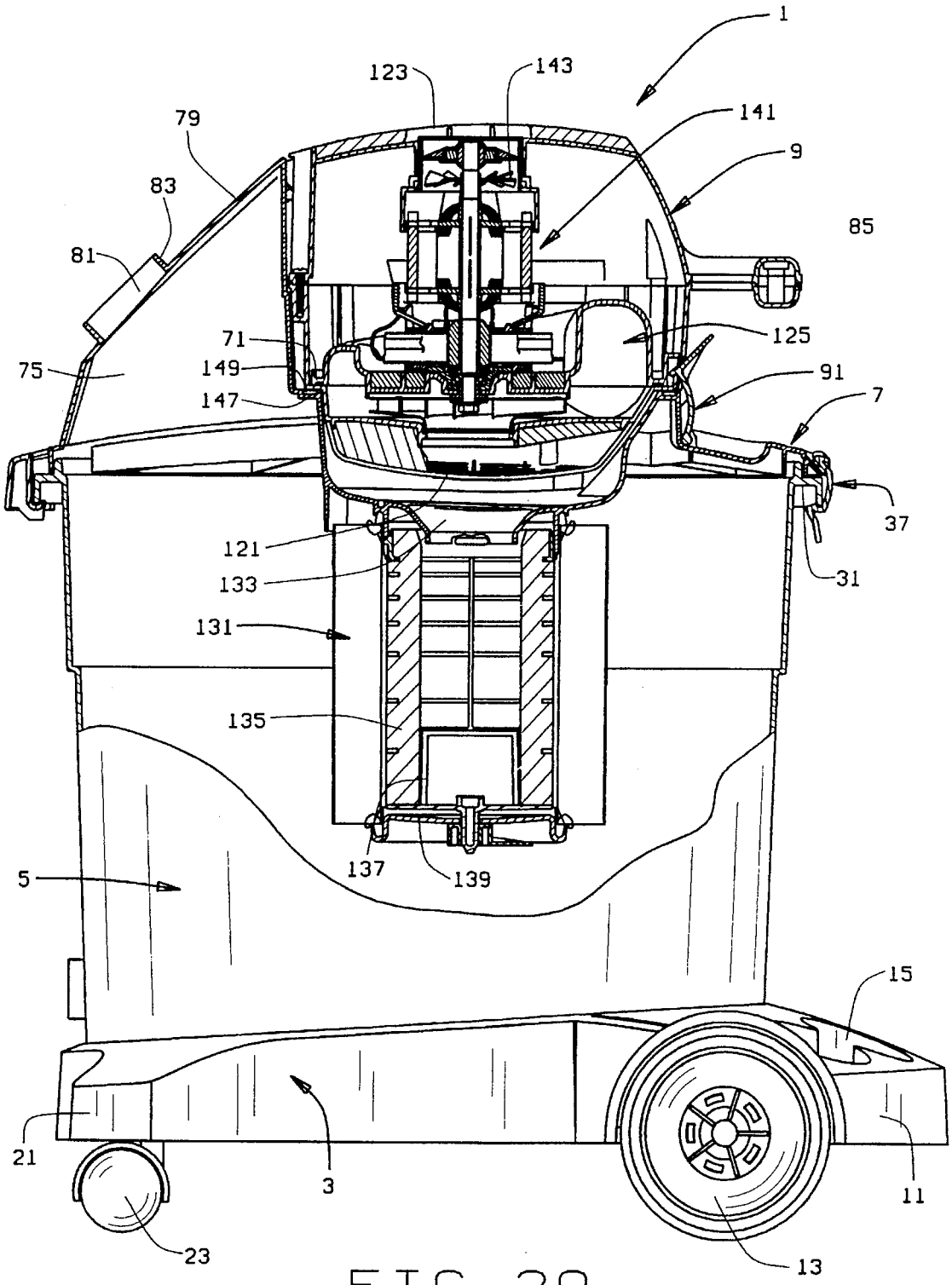
FIG. 20 is an exploded side view of the vacuum cleaner with detachable blower illustrated in FIG. 1.
Figure 21:
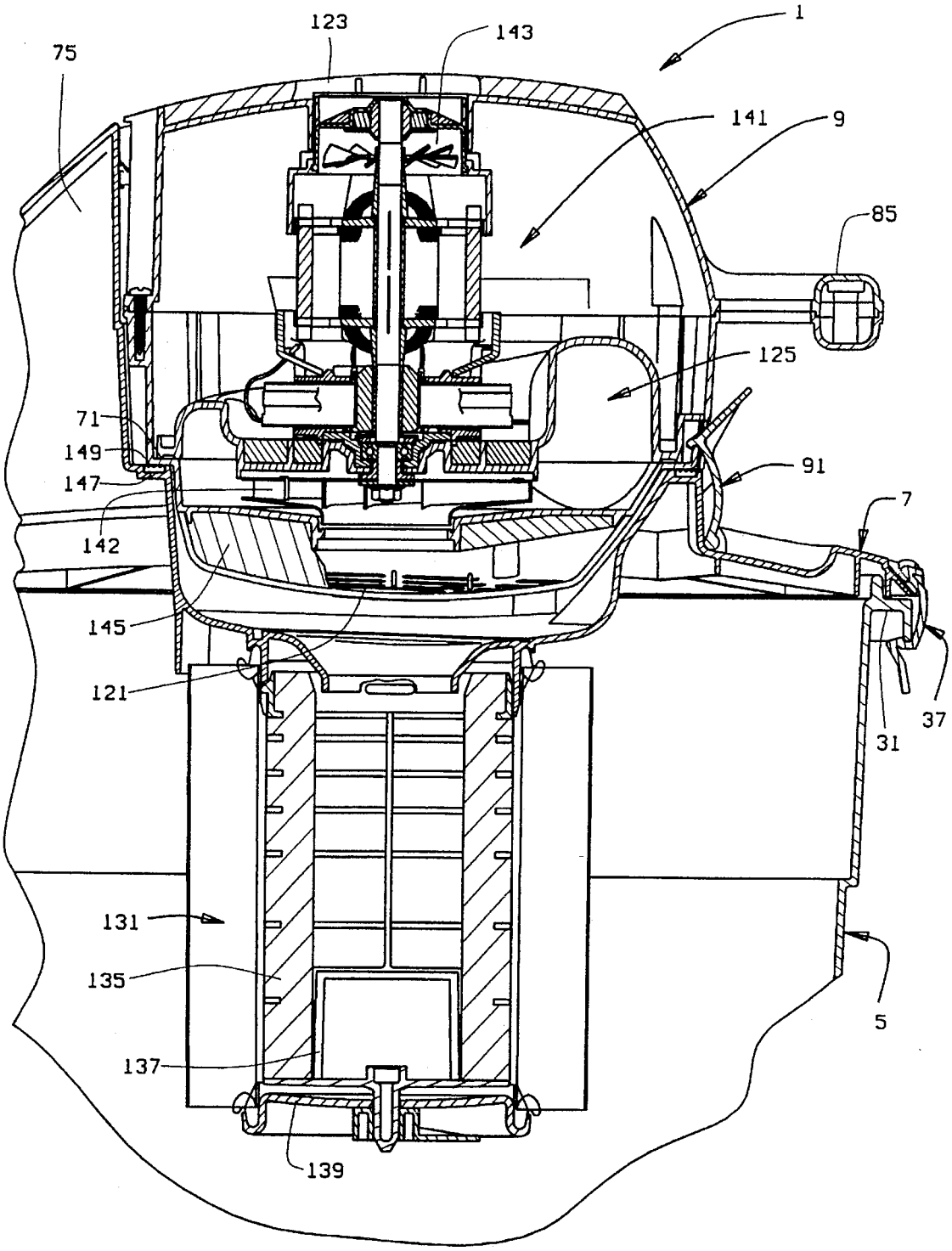
FIG. 21 is an enlarged detail of the vacuum cleaner with detachable blower illustrated in FIG. 20.

FIGS. 20–21 of the drawings show the operation of the wet/dry utility vacuum cleaner 9 with the detachable blower 9 in assembled position. Within the vacuum cleaner drum 5, a filter assembly 131 depends from the undersurface of the lid 7 in surrounding relationship to an opening 133 in the lid 7. The filter assembly 131 fits over a hollow cylindrical cage 135 which surrounds the opening 133 at an upper end and receives a float 137 within the hollow inner cylindrical cage 135 at its lower end. An end cap 139 is attached to the bottom of the cage 135 and holds the filter assembly 131 in the position illustrated. The float 137 rests on the bottom of the cage 135. The filter assembly 131 filters debris from air vacuumed into the vacuum cleaner drum 5 through the inlet port 81 of the hood 79. As indicated above, the air inlet port 81 receives a vacuum hose for depositing air and debris into the wall cavity 75 of the lid 7 for containment within the vacuum cleaner drum 5. Solid particle debris will be collected within the interior of the vacuum cleaner drum 5 at its bottom, while debris suspended in air will be filtered by the air filter 131 for exhaust of the cleaned air upwardly through the opening 133 and into the blower 9 through the air inlet slots 121.

When the wet/dry utility vacuum cleaner 1 is operated to collect spilled liquids, the spilled liquid as well as air and debris will be deposited through the air inlet port 81 into the upper wall cavity 75 and into the vacuum cleaner drum 5. As the spilled liquid rises to the level of the float 137, the float 137 will begin to rise within the air filter 131 and cage 135 and will continue to rise as the water rises to the point where the float 137 will close off the opening 133 such that no liquid can enter into and affect the operation of the blower 9.

Within the blower 9, there is mounted an electric motor 141 which creates the air flow within and through the blower 9. The motor 141 illustrated in FIGS. 16–17 of the drawings is preferably of the type described in detail in copending patent application Ser. No. 08/236,198 filed May 2, 1994 entitled METHOD OF ASSEMBLING AN ELECTRIC MOTOR, now U.S. Pat. No. 5,487,213 which is assigned to the same assignee as the present invention.

The electric motor 141 provides two separate air flows: motor coolant air flow and vacuum/blower air flow. Specifically, the electric motor 141 includes a fan blade 143 which draws air through the motor cooling air inlet slots 124 for exhaust through the motor exhaust vent slots 123. The motor 141 also includes a blower wheel 142 which draws air through the air inlet slots 121 for exhaust through the blower exhaust 119. Thus, the motor 141 operates to draw air through the filter 131 up through the opening 133, through the air inlet vent slots 121. In addition, an air intake shield or filter 145 mounted adjacent the air inlet vent slots 121 to further filter the incoming air.

In order for air to be drawn through the blower 9 for venting through the exhaust port 119, the blower 9 must be sealed relative to the lid 7. For this purpose, the lower circumferential shoulder 71 of the blower 9 engages a complementary shaped circumferential shoulder 147 having a circumferential gasket 149 embedded therein such that when the circumferential sealing shoulder 71 engages the gasket 149 mounted in the shoulder 147 surrounding the depression or recessed cavity 61 in the lid 7, a sealed relationship will be established. This sealed relationship is assisted by the detachable blower latch 91 and the locking tabs 120, 120, which function as described above, for holding the blower 9 in assembled relationship to the lid 7. Thus, the detachable blower 9 can then function together with the wet/dry utility vacuum cleaner 1 in joint operation in the manner described above.

Figure 22:
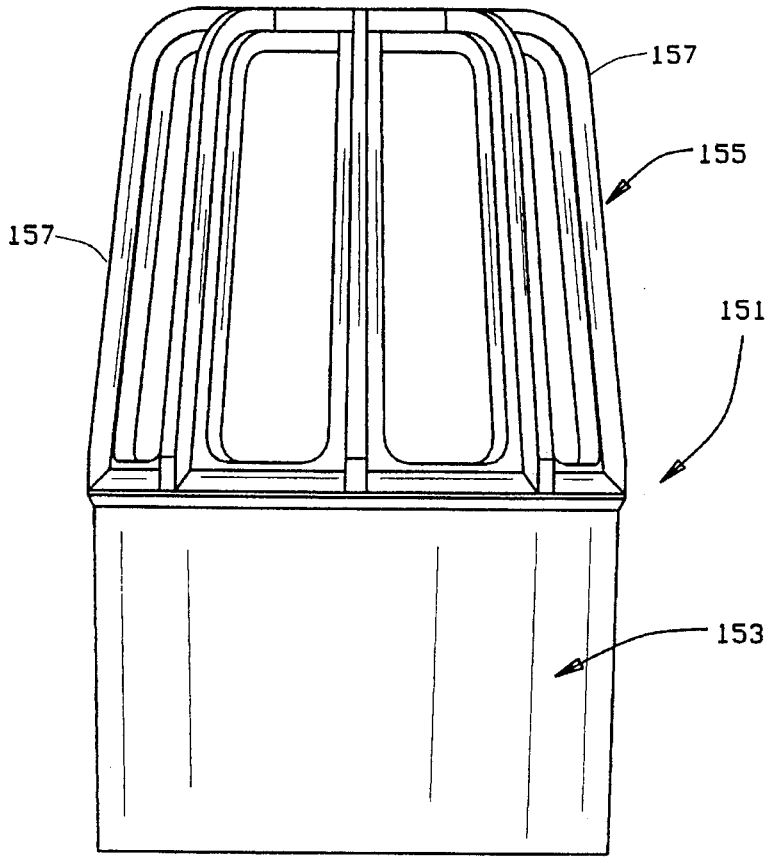
FIG. 22 is a side elevational view of the blower exhaust diffuser.
Figure 23:
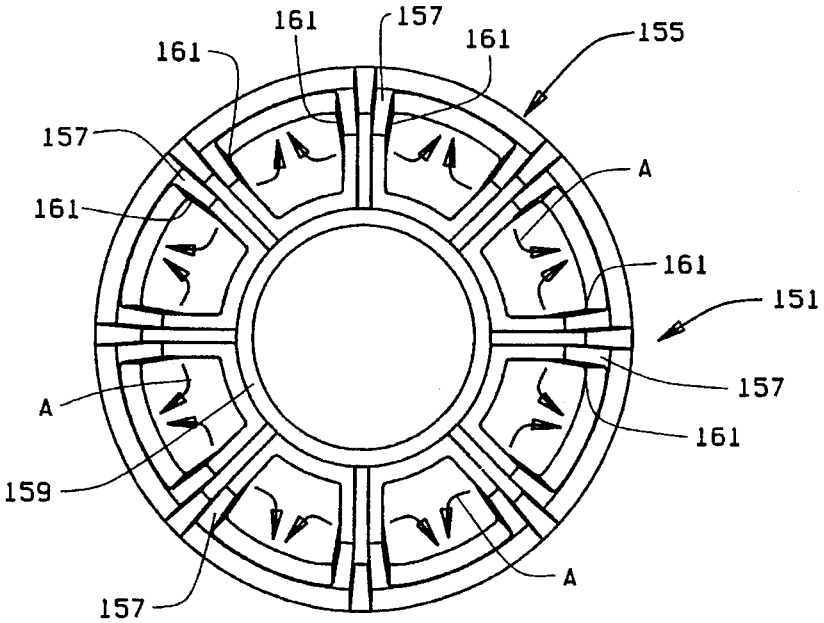
FIG. 23 is a top plan view of the diffuser illustrated in FIG. 22.

When the detachable blower 9 is operated together with a wet/dry utility vacuum cleaner 1, the air diffuser 151 shown in FIGS. 22–23 has been found to be particularly useful. The air diffuser 151 is a one-piece molded plastic element including an exhaust connector section 153 that fits within the blower exhaust port 119 and an air diffuser section 155 integrally joined to the exhaust connector section 153. The exhaust connector section 153 has a cylindrical wall for insertion into the exhaust port 119 of the detachable blower 9. The air diffuser section includes a series of circumferentially spaced and longitudinally extending air diffuser fins 157 which are attached to the cylindrical wall of the exhaust connector section 153 at one end and are interconnected to one another at a second end through an end ring 159. The end ring 159 has a predetermined smaller diameter than the cylindrical wall of the exhaust connector section 153.

As will be seen, each of the air diffuser fins 157 have a cross sectional shape that includes outwardly tapering side sections 161, 161 on opposite sides of each air diffuser fin 157. In the illustrated embodiment, there are eight equally spaced air diffuser fins 157.

Figure 19:
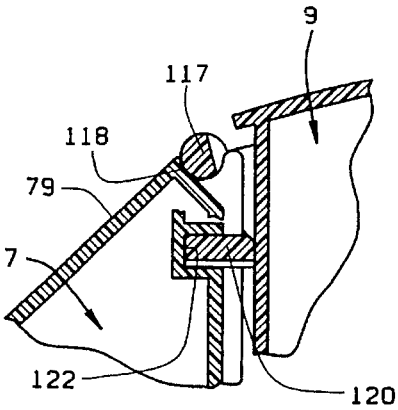
FIG. 19 is an end elevational view of the air diffuser shown in FIG. 18 and illustrating the circumferential break-up or dispersion of air for reducing exhaust air velocity.
Figure 18:
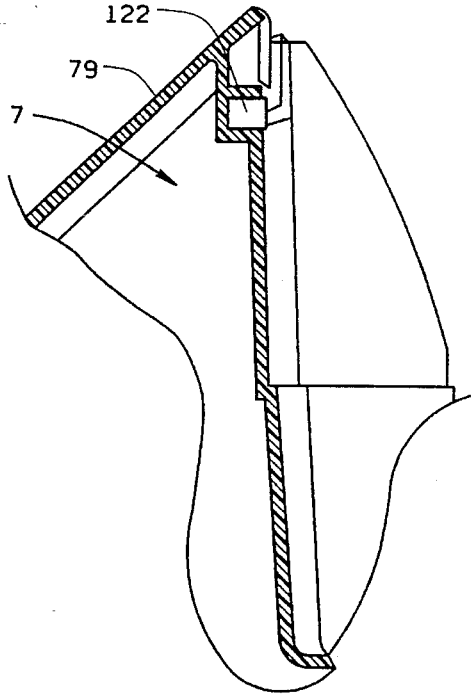
FIG. 18 is a side elevational view of an air diffuser that is used with the detachable blower when mounted to the wet/dry utility vacuum cleaner.

Each of the air diffuser fins 157 are thus configured, arranged and dimensioned to divert and break up exhaust air emanating from the blower exhaust 119 into a series of separate circumferentially directed air paths around the air diffuser fins 157 for reducing exhaust air velocity. Without the air diffuser fins 157, a powerful exhaust air stream will be discharged from the blower exhaust 119 and can be disruptive in a tool or work room by dislodging articles from tool tables and the like. As will be appreciated, the break up and diversion of the exhaust air into separate circumferentially air paths as illustrated by the arrows shown in FIG. 19 of the drawings will eliminate a powerful discharge air stream that may disrupt a user in the operation of the wet/dry utility vacuum cleaner 1.

From the foregoing, it will now be appreciated that the wet/dry utility vacuum cleaner with detachable blower will enable operation of such unit as a wet/dry utility vacuum cleaner when the detachable blower is mounted in sealed relationship, while also enabling the detachable blower to be separated from the utility vacuum cleaner drum for separate non-vacuuming applications. It will thus be seen that the novel and unique features incorporated in the wet/dry utility vacuum cleaner with detachable blower of the present invention achieves the above discussed objects and features of this invention, as well as provides other advantageous results.

As various changes could be made in the above construction without departing from the scope of the invention, it is intended that all matter contained in the above description or shown in the accompanying drawings shall be interpreted as illustrative and not in a limiting sense.

We claim:

1. A wet/dry utility vacuum cleaner including:

a vacuum cleaner drum having a bottom wall, a sidewall and an enlarged rim surrounding an open upper end;

a lid detachably mounted to the enlarged rim and extending across the open upper end of the vacuum cleaner drum;

a depression within said lid and an opening in said depression that communicates with said drum;

a filter element mounted below said depression within said drum and surrounding the opening in the depression;

a motor powered blower at least partially received within said depression and detachably mounted to said lid for independent operation separate from said drum, said blower including an intake port for drawing air through said filter element and an exhaust port spaced from said intake port for exhausting air from said drum;

said lid including a releasable lid latch and a releasable blower latch; and both said releasable lid latch and said releasable blower latch being constructed for convenient one-handed engagement or disengagement of said releasable lid latch relative to said drum and said releasable blower latch relative to said lid.

2. The wet/dry utility vacuum cleaner as defined in claim 1 wherein said lid includes a hook portion which engages the enlarged rim of said drum in general opposition to said releasable lid latch to facilitate the holding of said lid relative to said drum.

3. The wet/dry utility vacuum cleaner as defined in claim 2 wherein the releasable blower latch is pivotally mounted to said lid and detachably engages a complementary latch opening in said blower, said releasable blower latch including an upstanding finger engageable portion for convenient one-handed movement of said releasable blower latch into engagement or disengagement relative to said blower.

4. The wet/dry utility vacuum cleaner as defined in claim 3 including blower pivot supports and locking tabs which engage the blower to prevent removal of the blower until the releasable blower latch is released.

5. The wet/dry utility vacuum cleaner as defined in claim 3 wherein the blower includes a U-shaped handle extending outwardly from the blower immediately above the releasable blower latch, said U-shaped handle and releasable blower latch being mounted into proximity to one another to enable a user to both grip the U-shaped handle and with one finger engage or disengage the releasable blower latch for removal or replacement of the detachable blower relative to the depression.

6. A wet/dry utility vacuum cleaner including:

a vacuum cleaner drum having a bottom wall, a sidewall and an enlarged rim surrounding an open upper end;

a lid detachably mounted to the enlarged rim and extending across the open upper end of the vacuum cleaner drum, said lid including a releasable lid latch for engaging the enlarged rim of said drum, said releasable lid latch being pivotally mounted to said lid and including a releasable locking element for engaging the enlarged rim and a finger gripping section for convenient one-handed engagement or disengagement of the releasable lid latch to the enlarged rim of the drum;

a depression within said lid and an opening in said depression that communicates with said drum;

a filter element mounted below said depression within said drum and surrounding the opening in the depression;

a motor powered blower at least partially received within said depression and detachably mounted to said lid for independent operation separate from said drum, said blower including an intake port for drawing air through said filter element and an exhaust port spaced from said intake port for exhausting air from said drum; and said lid having a circumferential sealing shoulder surrounding said depression which engages a complementary shaped circumferential shoulder provided on said blower in order to seal the blower relative to said lid when the blower is detachably mounted to said lid.

7. A wet/dry utility vacuum cleaner, including:

a vacuum cleaner drum having a bottom wall, a side wall and an enlarged rim surrounding an open upper end;

a lid extending across the open upper end of said drum and including a depression for receiving a motor powered blower;

said lid including a releasable lid latch for releasably engaging the enlarged rim of said drum;

said releasable lid latch being constructed for convenient one-handed engagement or disengagement of said releasable lid latch for corresponding engagement or removal of said lid relative to said drum;

said blower including a blower housing that is detachably mounted in said depression, said blower housing having an integral U-shaped handle extending from one end;

a finger engageable/disengageable releasable blower latch attached to said lid for engaging said blower housing; and said releasable blower latch being mounted in proximity to the U-shaped handle of said blower housing in order to enable a user to both grip the U-shaped handle and with one finger engage or disengage the releasable blower latch for removal or replacement of the detachable blower relative to the depression in the lid.

8. The wet/dry utility vacuum cleaner as defined in claim 7 wherein the blower housing at an end opposite to said U-shaped handle includes supporting pads for resting the detachable blower on a supporting surface in an upright position.

9. The wet/dry utility vacuum cleaner as defined in claim 8 wherein the supporting pads are also constructed as pivots which function in conjunction with locking tabs mounted on the blower for engagement within complementary shaped openings of the lid until the releasable blower latch is released.

10. The wet/dry utility vacuum cleaner as defined in claim 8 wherein the blower has a blower exhaust that is positioned between the U-shaped handle and the supporting pads on one side of the blower housing and vent slots are formed on an adjacent side of the blower housing to enable continuous blower operation without vacuuming debris into the vent slots.

11. The wet/dry utility vacuum cleaner as defined in claim 10 wherein the U-shaped handle extends to one side of the blower housing on a side opposite said blower exhaust to facilitate lifting and carrying the blower while operating same.

12. The wet/dry utility vacuum cleaner as defined in claim 10 and further including switch means mounted on said U-shaped handle for operating said detachable blower.

* * * * *